US011987978B2

(12) United States Patent
Mohanraj et al.

(10) Patent No.: US 11,987,978 B2
(45) Date of Patent: May 21, 2024

(54) MOISTURE BARRIER SYSTEM

(71) Applicant: Berry Global, Inc., Evansville, IN (US)

(72) Inventors: Jagannathan Mohanraj, Sutton Coldfield (GB); Cameron R. Yates, Glasgow (GB); Stephen R. D'Arcy, Lancashire (GB); Philip N. Bull, Hertfordshire (GB)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 17/876,821

(22) Filed: Jul. 29, 2022

(65) Prior Publication Data

US 2023/0036810 A1 Feb. 2, 2023

Related U.S. Application Data

(60) Provisional application No. 63/243,953, filed on Sep. 14, 2021, provisional application No. 63/227,551, filed on Jul. 30, 2021.

(51) Int. Cl.
*E04B 1/68* (2006.01)

(52) U.S. Cl.
CPC ..... *E04B 1/6815* (2013.01); *E04B 1/6807* (2013.01)

(58) Field of Classification Search
CPC ..... E04B 1/644; E04B 1/6807; E04B 1/6815; E04B 1/7038
See application file for complete search history.

(56) References Cited

U.S. PATENT DOCUMENTS 2,175,110 A * 10/1939 Hyman ..... E04B 1/7046 52/204.5
3,483,664 A * 12/1969 Malone, Jr. ..... E04D 13/16 428/317.1
4,421,581 A * 12/1983 Olsen ..... E04D 7/00 427/407.1
4,668,315 A * 5/1987 Brady ..... E04D 11/02 156/304.6
4,700,512 A * 10/1987 Laska ..... E04D 13/1407 52/287.1
5,027,572 A * 7/1991 Purcell ..... E04B 1/66 52/363
5,349,792 A * 9/1994 Bayes ..... E04D 13/1478 52/412
5,417,017 A * 5/1995 Toutountzis ..... A01M 1/24 245/8
5,598,673 A * 2/1997 Atkins ..... E04B 1/7612 52/302.1

(Continued)

FOREIGN PATENT DOCUMENTS

GB 2500874 A 10/2013
WO 1999014442 A1 3/1999
WO 2021084047 A1 5/2021

OTHER PUBLICATIONS

International (PCT) Search Report and Written Opinon for PCT/US22/38818 dated Dec. 6, 2022, 16 pages.

(Continued)

*Primary Examiner* — James M Ference
(74) *Attorney, Agent, or Firm* — Barnes & Thornburg LLP

(57) ABSTRACT

A moisture barrier system, comprising a barrier sheet adapted to be installed on a building having an interior wall structure and an exterior wall structure spaced apart from the interior wall structure to define a cavity there between.

20 Claims, 8 Drawing Sheets

(56) References Cited

U.S. PATENT DOCUMENTS 6,122,874 A * 9/2000 Smerilli ..... E04B 1/644 52/293.3
6,182,412 B1 * 2/2001 Traxler ..... E04B 1/72 43/132.1
6,233,890 B1 * 5/2001 Tonyan ..... E04F 13/06 52/302.1
6,256,955 B1 * 7/2001 Lolley ..... E04B 1/7675 52/302.1
6,656,557 B2 * 12/2003 Phillips ..... B32B 11/04 428/351
6,945,000 B1 * 9/2005 Hohmann ..... E04B 1/7046 428/297.1
RE39,223 E * 8/2006 Toutountzis ..... A01M 29/34 245/8
7,823,355 B1 * 11/2010 Hohmann, Jr. ..... E04B 1/7046 428/297.4
7,882,673 B1 * 2/2011 Hohmann, Jr. ..... B32B 27/08 52/61
8,046,956 B1 * 11/2011 Hohmann, Jr. ..... E04B 1/7046 52/302.1
8,522,508 B1 * 9/2013 Collins ..... E04B 1/7046 52/61
8,609,213 B2 * 12/2013 Wiercinski ..... C09J 7/20 428/354
8,776,447 B2 * 7/2014 Koch ..... B32B 27/20 52/379
9,097,006 B2 * 8/2015 Johnson ..... E04B 1/7038
9,151,043 B1 * 10/2015 Fritz ..... E04B 2/44
9,316,004 B1 * 4/2016 Hatzinikolas ..... F16M 13/02
9,447,585 B2 * 9/2016 Hatzinikolas ..... E04F 13/0857
10,947,721 B2 * 3/2021 Schepens ..... E04B 1/7053
2003/0208964 A1 * 11/2003 Batt, Sr. ..... E04D 13/1475 52/11
2003/0230035 A1 * 12/2003 Collins ..... E04B 1/70 52/302.1
2006/0053738 A1 * 3/2006 Jaffee ..... B32B 21/10 52/741.3
2006/0283101 A1 * 12/2006 Sourlis ..... E04B 1/7046 52/58
2007/0054086 A1 3/2007 Pagel
2007/0068093 A1 * 3/2007 Grange ..... E02D 31/02 52/169.5
2007/0084139 A1 * 4/2007 Stender ..... E04B 1/7069 52/302.1
2007/0186501 A1 8/2007 Kuelker
2008/0104918 A1 * 5/2008 Gleeson ..... E04F 13/08 52/489.1
2010/0173112 A1 * 7/2010 Wiercinski ..... B32B 5/12 442/45
2010/0287862 A1 * 11/2010 Goldberg ..... E04B 1/70 52/309.3
2011/0120025 A1 * 5/2011 Matthews ..... E04F 13/06 52/62
2011/0277393 A1 * 11/2011 Hohmann, Jr. ..... B32B 33/00 156/154
2011/0302863 A1 * 12/2011 Sourlis ..... E02D 19/00 52/302.1
2012/0042582 A1 * 2/2012 Hohmann, Jr. ..... E04B 1/7046 52/62
2012/0233947 A1 * 9/2012 Koch ..... E04B 1/665 52/302.1
2012/0255250 A1 * 10/2012 Wetmore ..... E04B 1/7046 52/302.6
2013/0205687 A1 * 8/2013 Sala ..... E04B 1/38 428/190
2013/0283718 A1 * 10/2013 Robinson ..... E04B 2/04 52/561
2014/0202096 A1 * 7/2014 Johnson ..... E04B 1/7038 52/302.6
2014/0272238 A1 * 9/2014 Hohmann, Jr. ..... E04B 1/7046 264/211
2014/0360109 A1 * 12/2014 Goldberg ..... E02D 19/00 52/302.1
2017/0204602 A1 * 7/2017 Collins ..... E04B 1/7046
2017/0234005 A1 * 8/2017 Yuasa ..... E04B 1/803 52/406.2
2018/0251661 A1 * 9/2018 Uno ..... E01D 19/103
2018/0290427 A1 * 10/2018 Humphreys ..... E04B 1/64
2018/0347192 A1 * 12/2018 Hartman ..... B32B 5/022
2019/0277025 A1 * 9/2019 Sander ..... E04B 1/6803
2019/0308395 A1 * 10/2019 Wang ..... C09D 183/04
2020/0109555 A1 * 4/2020 Schepens ..... E04B 1/644
2020/0240101 A1 * 7/2020 Rudyan ..... E02D 31/025
2021/0164219 A1 * 6/2021 Couturier ..... E04B 1/665
2021/0189718 A1 * 6/2021 Sander ..... E04B 1/6803
2021/0222391 A1 * 7/2021 Rudyan ..... B32B 13/12
2023/0036810 A1 * 2/2023 Mohanraj ..... E04B 1/6807

OTHER PUBLICATIONS

International (PCT) Search Report and Written Opinion for PCT/US22/53367 dated May 26, 2023, BP-576 PCT || 12 pages.

* cited by examiner

MOISTURE BARRIER SYSTEM

PRIORITY CLAIM

This application claims priority under 35 U.S.C. § 119(e) to U.S. Provisional Application Ser. No. 63/227,551, filed Jul. 30, 2021, and U.S. Provisional Application Ser. No. 63/243,953, filed Sep. 14, 2021, each of which is expressly incorporated by reference herein.

BACKGROUND

The present disclosure relates to cavity walls and particularly, although not exclusively, to moisture barriers for cavity walls, including cavity trays and damp-proof courses.

SUMMARY

A moisture barrier system, in accordance with the present disclosure, is adapted to be installed on a building. The building has an interior wall and an exterior wall spaced apart from the interior wall to define a cavity there between.

In illustrative embodiments, the moisture barrier system includes a barrier sheet that spans the cavity and a sheet support system that supports and retains the barrier sheet to the building. The barrier sheet includes an interior reinforcement mesh and an outer polymeric layer encapsulating the interior reinforcement mesh. The sheet support system configured to support and join the barrier sheet to both the interior wall and the exterior wall.

In illustrative embodiments, the sheet support system includes sealant coupled to an exterior-facing surface of the interior wall to lie between the exterior-facing surface and an upper section of the barrier sheet. The sheet support system further includes a corner unit arranged to extend around a corner of the building and to lie beneath the barrier sheet at the corner. The sheet support system further includes a surface fixing system configured to mount the upper section of the barrier sheet to the interior wall, the surface fixing system including an attachment strip and a plurality of fasteners that each extend through a corresponding opening formed in the attachment strip, through the upper section of the barrier sheet, and into the interior wall.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1A is a perspective view of a portion of a building including an interior wall and an exterior wall spaced apart from the interior wall to define a wall cavity between the interior wall and the exterior wall and showing a moisture barrier system being installed to the building to extend across the wall cavity from the interior wall to the exterior wall to direct moisture resident in the wall cavity away from the interior wall and toward openings formed in the exterior wall to be released from the wall cavity through the openings;

FIG. 1B is a cross sectional view of a barrier sheet included in the moisture barrier system from FIG. 1A showing that the barrier sheet includes an outer polymeric layer and the interior reinforcement mesh integrated within the polymeric layer so that the polymeric layer provides top and bottom sides of the barrier sheet and extends through spaces between individual fiber weave or portions of the interior reinforcement mesh;

FIG. 2 is an exploded assembly view of the moisture barrier system to show that the moisture barrier system includes a barrier sheet and a sheet-support system configured to attach and retain the barrier sheet to the building in an installed position spanning the wall cavity;

FIG. 3 is a cross-sectional view taken along line 3-3 in FIG. 1 showing that the sheet-support system includes a surface fixing system configured to mount an upper attachment section of the barrier sheet to the interior wall, the surface fixing system including an attachment strip and a plurality of fasteners that extend through corresponding openings formed in the attachment strip and into the interior wall, and showing that a lower attachment section of the barrier sheet is arranged to lie between two layers of bricks included in the exterior wall to mount the barrier sheet to the exterior wall;

Figure 10:
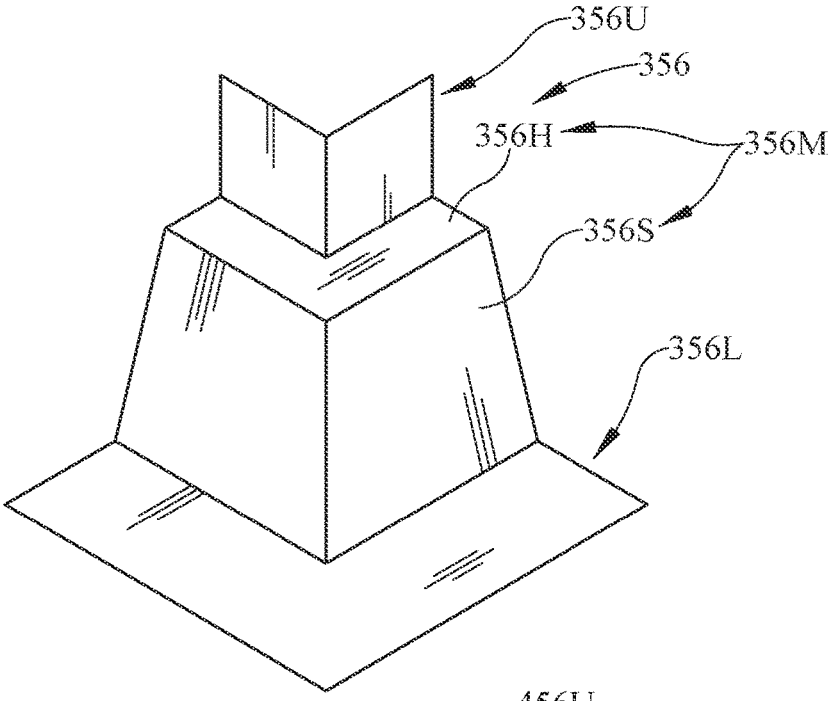
Figure 11:
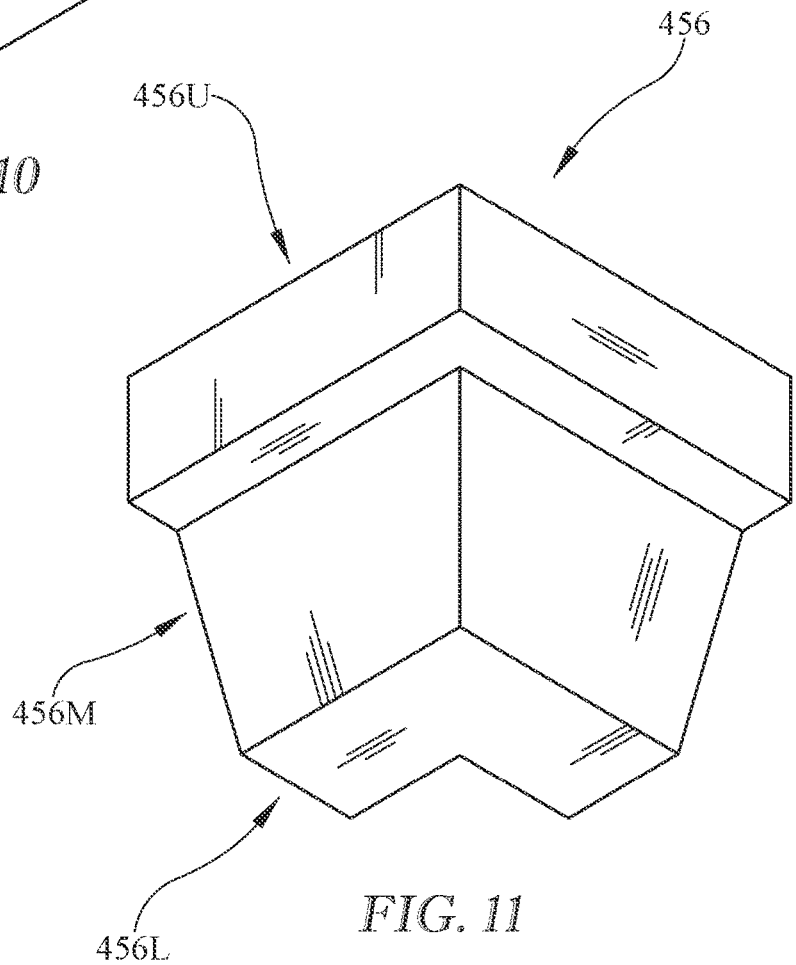

FIG. 10 is a perspective view of another external corner support included in the sheet-support system which is configured to extend between the interior wall and the exterior wall along an external corner section of the building to support the barrier sheet in an external corner formation along an external corner section of the building; and FIG. 11 is a perspective view of another internal corner support included in the sheet-support system which is configured to extend between the interior wall and the exterior wall along an internal corner section of the building to support the barrier sheet in an internal corner formation along the external corner section of the building.

DETAILED DESCRIPTION

Figure 1A:
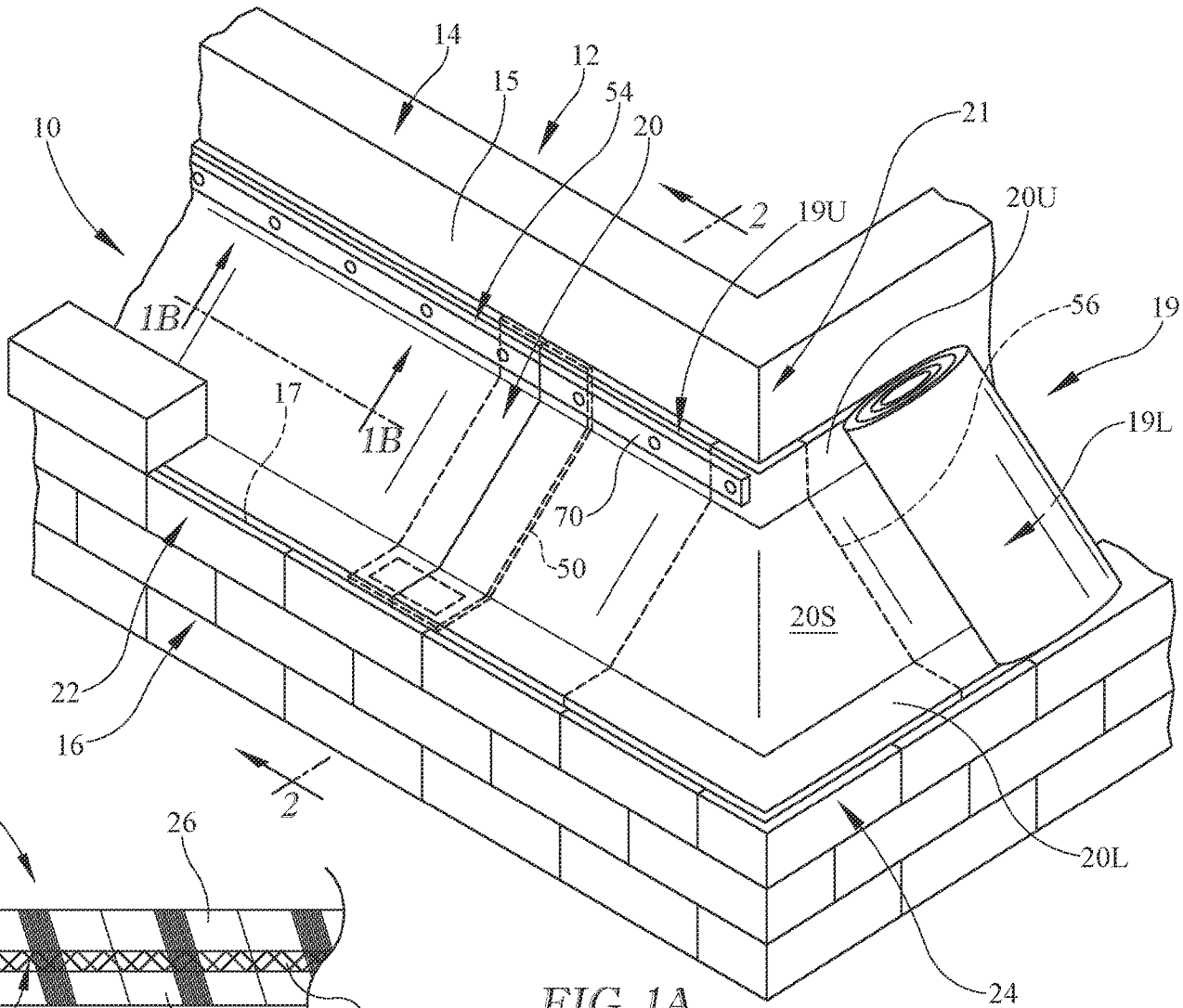
Figure 1B:
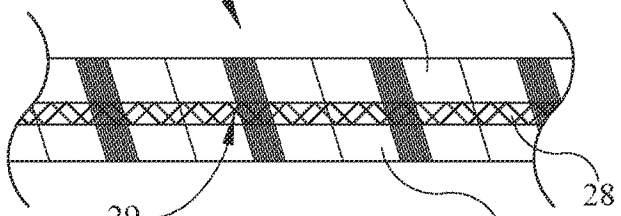
Figure 2:
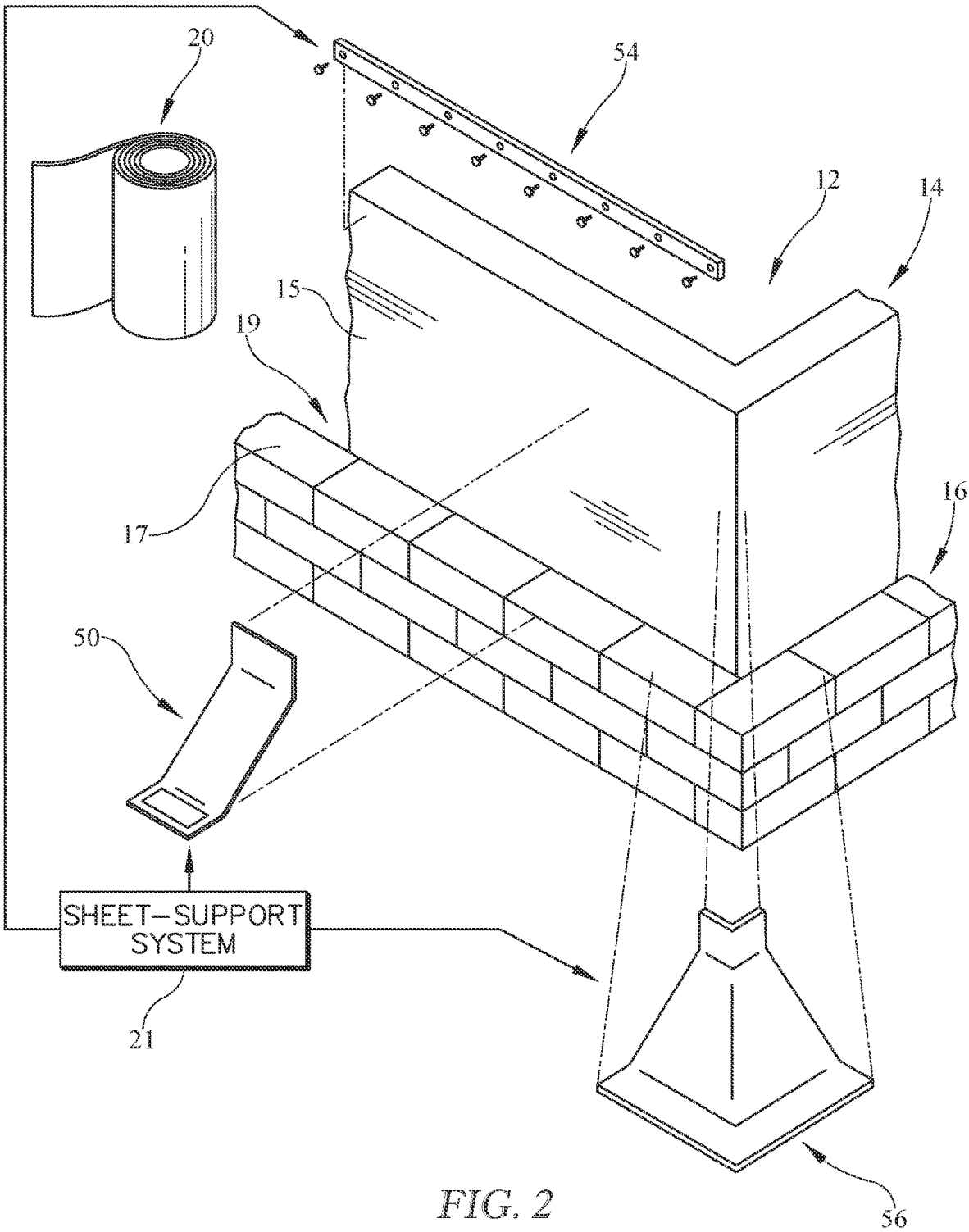
Figure 3:
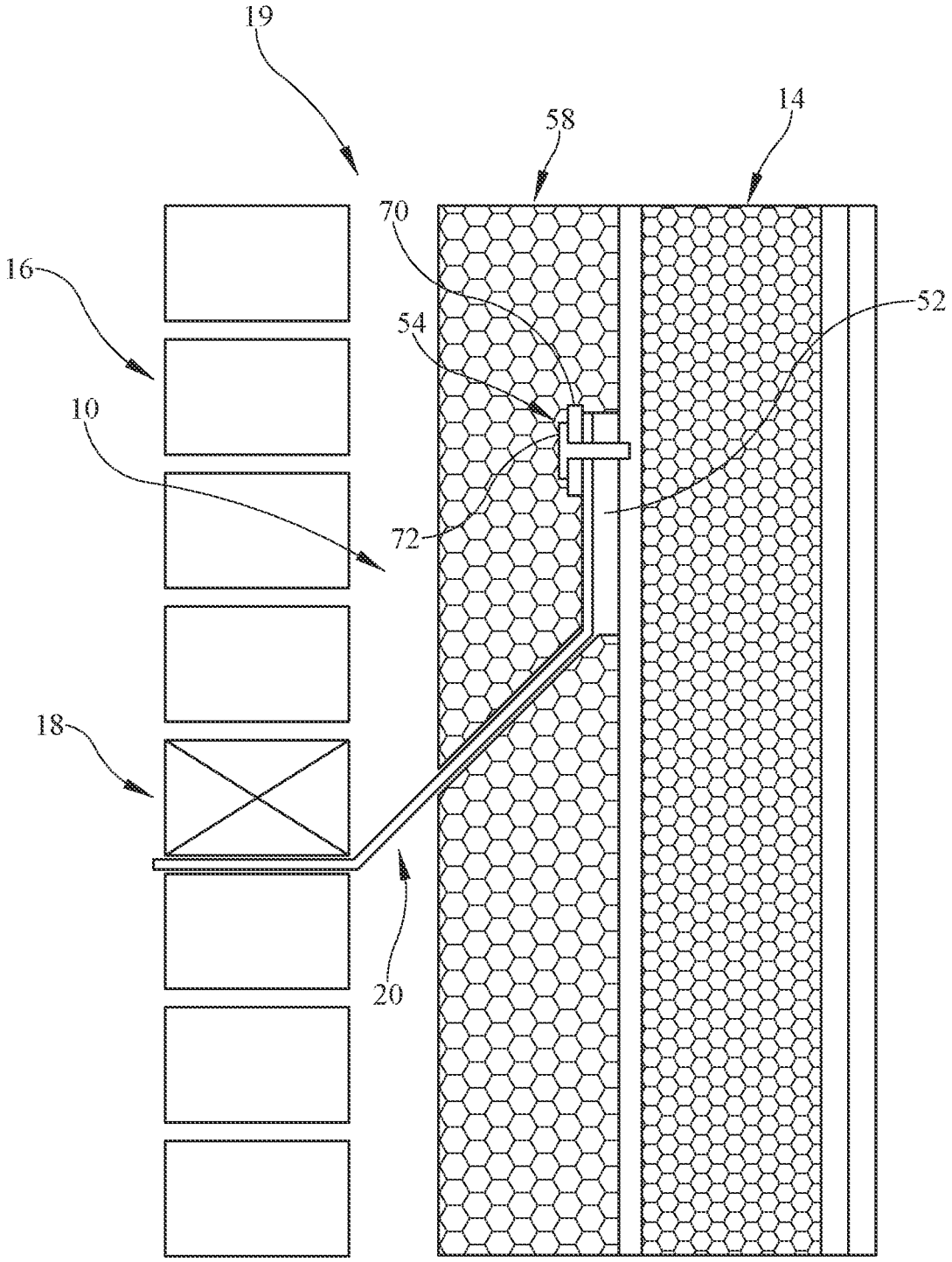

A moisture barrier system 10 for a building 12 is shown in FIGS. 1-3. The moisture barrier system 10 is adapted to be installed on building 12 between an interior wall 14 and an exterior wall 16 of the building 12. The moisture barrier system 10 is configured to block passage of moisture between the exterior wall 16 and the interior wall 14 and is configured to direct accumulated moisture on portions of the moisture barrier system 10 toward exit apertures 18 (i.e.

weep holes) formed in the exterior wall 16 as suggested in FIG. 3. In some embodiments, the moisture barrier system 10 is non-combustible.

Figure 7:
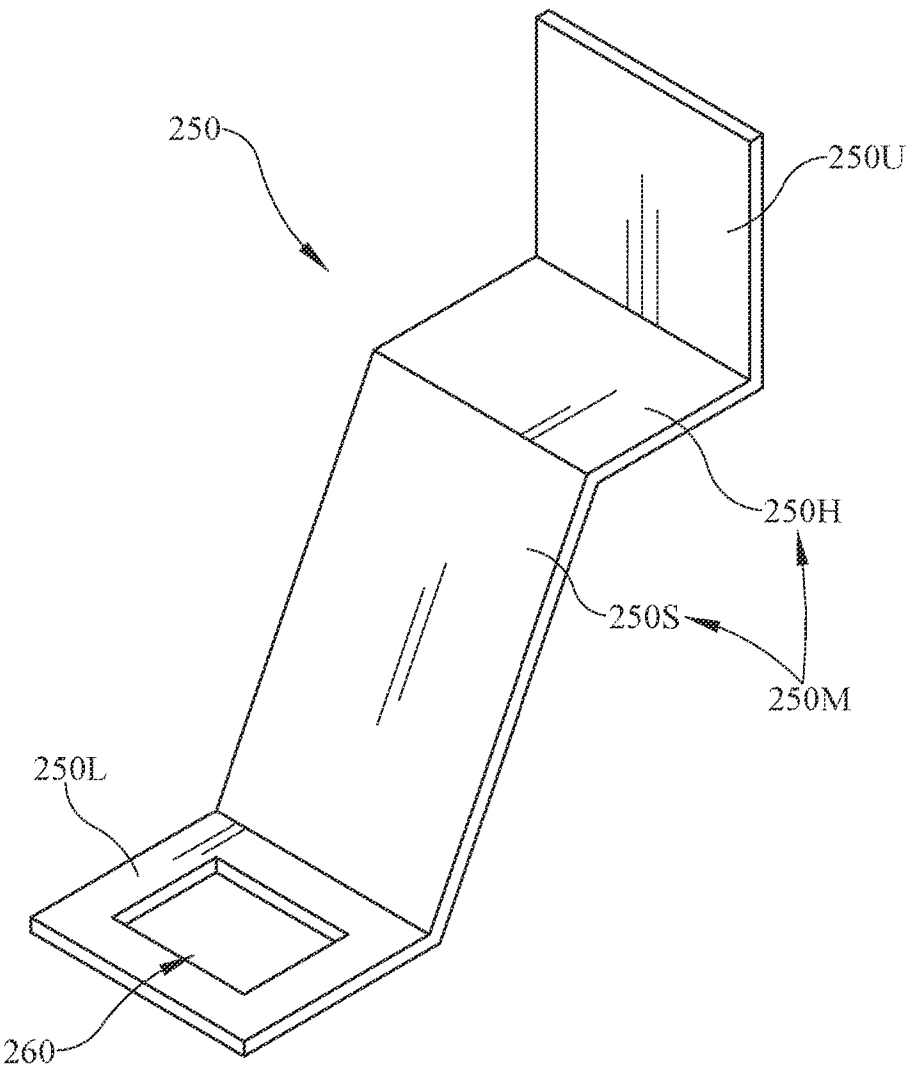
FIG. 7 is a perspective view of another embodiment of a joint support similar to the joint support shown in FIG. 6.
Figure 8:
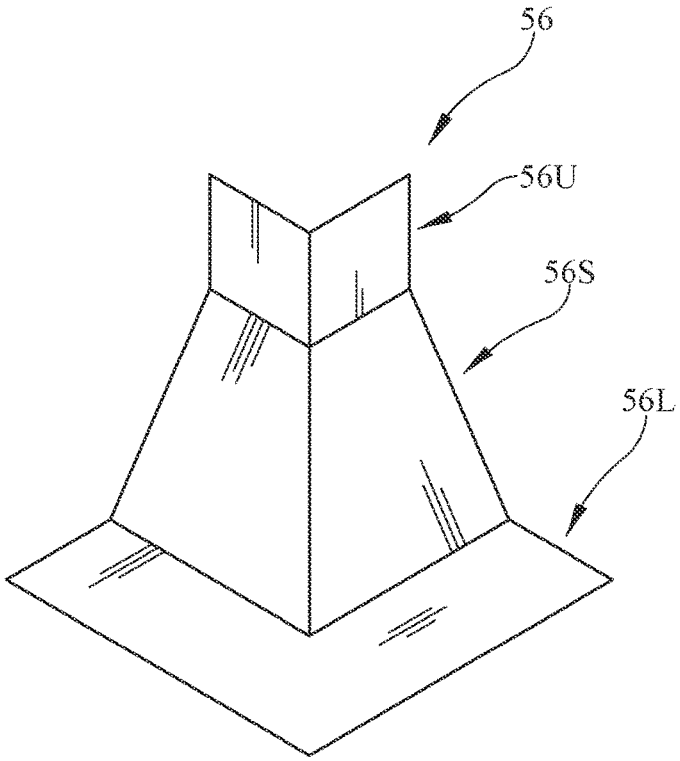
FIG. 8 is a perspective view of an external corner support included in the sheet-support system which is configured to extend between the interior wall and the exterior wall along an external corner section of the building to support the barrier sheet in an external corner formation along an external corner section of the building.

The moisture barrier system 10 includes a barrier sheet 20 and a sheet-support system 21 that mounts the barrier sheet 20 to the building 12 as shown in FIGS. 1-4. The barrier sheet 20 acts as a cavity tray that extends through a wall cavity 19 defined between the interior wall 14 and the exterior wall 16. The barrier sheet 20 may be initially rolled into a cylindrical shape and subsequently unrolled as the moisture barrier system 10 is installed along wall sections 22 and corner sections 24 (also called disruptions) of the building 12 as suggested in FIGS. 1 and 4. The sheet-support system 21 includes components that attach the barrier sheet 20 to the interior wall 14 and the exterior wall 16 including one or more joint supports 50, a sealant 52, a surface fixing system 54, and corner supports or molds 56 as shown in FIGS. 5, 7, and 8.

The barrier sheet 20 may be a multi-layer barrier sheet 20 in some embodiments. For example, the barrier sheet 20 may include an outer polymeric layer 26 and an interior reinforcement mesh 28 as shown in FIGS. 2 and 3. The outer polymeric layer 26 is moisture impermeable and fully encapsulates the interior reinforcement mesh 28 at upper and lower surfaces of the multi-layer barrier sheet 20. The interior reinforcement mesh 28 is made from a mesh material that supports and carries the outer polymeric layer 26. In other embodiments, the barrier sheet 20 is formed as a single layer of material(s) that is the same throughout the entire thickness of the barrier sheet 20.

The building 12 may further include other types of disruptions coupled to at least one of the interior wall 14 or the exterior wall 16 and/or located within the cavity 19 such as pylons, beams, studs, insulation, windows, doors, and/or vents, for example. The barrier sheet 20 may be deformed to accommodate any such disruption included in the building 12 so that the barrier sheet 20 forms a continuous moisture barrier around the building 12.

The barrier sheet 20 is installed on the building 12 in a manner that divides the wall cavity 19 into upper and lower cavity subsections 19U, 19L as shown in FIG. 1. Once installed, the barrier sheet 20 includes an upper attachment section 20U, a lower attachment section 20L, and medial sloped section 20S between the upper attachment section 20U and the lower attachment section 20L that provides a continuous seal between upper and lower cavity subsections 19U, 19L around a perimeter of the building 12. The upper attachment section 20U is configured to be attached to the interior wall 14. The lower attachment section 20L is configured to be attached to the exterior wall 16 below the upper attachment section 20U. The sloped section 20S extends between and interconnects the upper attachment section 20U and the lower attachment section 20L at a downwardly sloped angle relative to vertical faces of the interior wall 14 and exterior wall 16 to direct accumulated moisture away from the upper attachment section 20U and toward the lower attachment section 20L. The sloped section 20S can be installed vertically or at a gradient in some embodiments.

The barrier sheet 20 provides both a damp-proof course and a cavity tray for the building 12 in the illustrative embodiment. The upper attachment section 20U is parallel with an outwardly facing surface 15 of the interior wall 14. The upper attachment section 20U and the sloped section 20S cooperate to direct moisture downwardly toward openings 18 in exterior wall 16. The upper attachment section 20U and the sloped section 20S also cooperate to block moisture from traveling upwardly from lower cavity subsection 19L to upper cavity subsection 19U. The lower attachment section 20L is parallel with an upwardly facing surface 17 of the exterior wall 16. The upwardly facing surface 17 may be placed on top of one layer of masonry (i.e. bricks) or mortar that extend around a perimeter of the building 12. A second layer of masonry may then be placed on top of the lower attachment section 20L to locate the lower attachment section 20L between two layers of masonry and/or mortar.

In embodiments where the barrier sheet 20 is formed from a single layer of material or a composition of materials, the barrier sheet 20 may consist of the outer polymeric layer 26. The outer polymeric layer 26 formed from a moisture impermeable material to provide the damp proof course and the cavity tray for the building 12. In some embodiments, the outer polymeric layer 26 includes silicone. In some embodiments, the outer polymeric layer 26 includes polyurethane. In some embodiments, the outer polymeric layer 26 includes a thermoplastic. In some embodiments, the outer polymeric layer 26 includes rubber. In some embodiments, the outer polymeric layer 26 includes synthetic thermoplastic or thermoset rubber. In some embodiments, the barrier sheet 20 consists essentially of the outer polymeric layer 26.

The outer polymeric layer 26 may be the only layer included in the barrier sheet 20 that provides moisture resistance for the barrier sheet 20. The barrier sheet 20 is not laminated and is substantially free from adhesives and other materials that are combustible. Some examples of adhesives that may not be included in the barrier sheet 20 include epoxies and phenolics. In some embodiments, the barrier sheet 20 consists of the outer polymer layer 26 and the interior reinforcement mesh 28. In some embodiments, the barrier sheet 20 consists essentially of the outer polymer layer 26 and the interior reinforcement mesh 28.

When included in the barrier sheet 20, the inner reinforcement mesh 28 strengthens the outer polymeric layer 26 to increase puncture and tear resistance of the barrier sheet 20. The inner reinforcement mesh 28 may include at least one of glass fiber, aramids (meta and/or para), carbon fiber, graphite fiber, ultra-high-molecular-weight polyethylene (UHMWPE), PEEK (polyetheretherketone), and mineral wool. In some embodiments the inner reinforcement mesh 28 consists of glass fiber. In some embodiments the inner reinforcement mesh 28 consists of aramids. In some embodiments the inner reinforcement mesh 28 consists of carbon fiber. In some embodiments the inner reinforcement mesh 28 consists of graphite fiber. In some embodiments the inner reinforcement mesh 28 consists of UHMWPE. In some embodiments the inner reinforcement mesh 28 consists of PEEK. In some embodiments the inner reinforcement mesh 28 consists of mineral wool.

The inner reinforcement mesh 28 may be mono- or multi-filament. The inner reinforcement mesh 28 may be formed as a woven structure or an unwoven structure. In one embodiment, for example, the inner reinforcement mesh 28 is formed as a cross-weaved structure; in another embodiment an unwoven structure is provided with spun bonded fiber (for example short glass fibers embedded in a matrix polymer). The inner reinforcement mesh 28 may comprise at least 50% of a volume fraction of the barrier sheet 20.

In some embodiments, the barrier sheet 20 is a damp-proof course comprising a woven fiber matrix 28 impregnated and/or coated with a thermoset binding layer 26. In some embodiments, the barrier sheet 20 is a damp-proof course comprising a glass fiber reinforcing material 28 and a silicone matrix 26. In some embodiments, the barrier sheet 20 is a non-combustible damp-proof course comprising cross-weaved glass fiber impregnated and/or coated with silicone. In one example, non-combustible means that the material does not burn, produces limited smoke, and does not form flaming droplets when exposed to fire.

In some embodiments, the barrier sheet 20 is formed from a glass fiber cross weaved structure impregnated and coated with silicone. This provides a non-combustible, non-metallic composite structure with good puncture resistance. This makes the material particularly suitable for use as a cavity tray for a cavity wall. Aspects and embodiments of the present disclosure may provide one or more of the following features: non-metallic, water and damp resistant, flexible, easy to install, high puncture resistance, fiber reinforced product, and available in longer lengths.

The reinforcement mesh 28 may be formed to include a plurality of voids or openings 29 that extend all the way through the reinforcement mesh 28. The outer polymer layer 26 extends through the plurality of voids 29 to physically bond the outer polymer layer 26 on both sides of the reinforcement mesh 28 as shown in FIG. 3. The portions of the outer polymeric layer 26 extending through the voids 29 retain the outer polymeric layer 26 to the reinforcement mesh 28 and to encapsulate to the reinforcement mesh 28 on both sides thereof.

Figure 4:
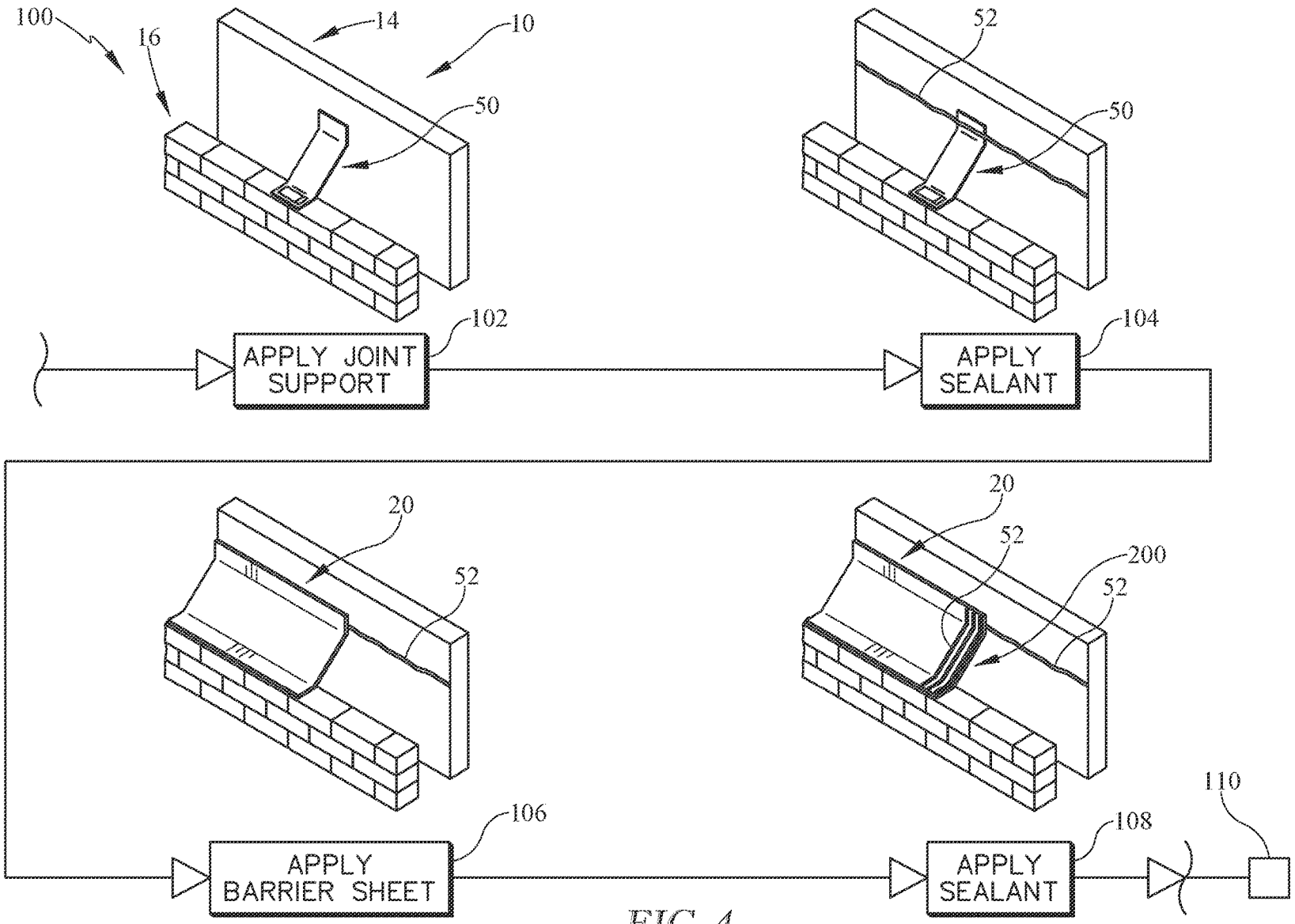
FIG. 4 is a series of views showing a process by which the barrier sheet is installed on a horizontal wall section of the building using the sheet-support system.
Figure 5:
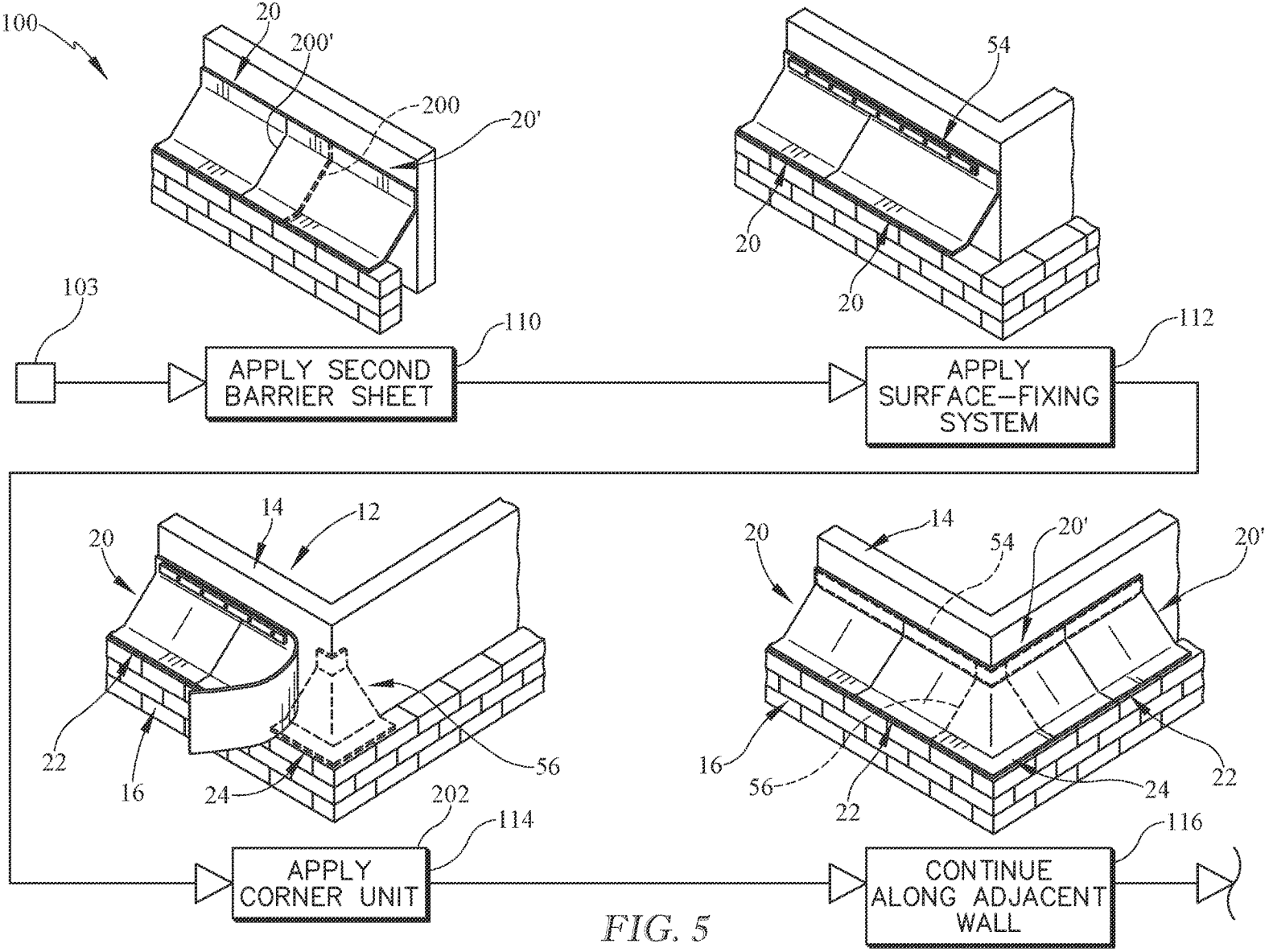
FIG. 5 is a series of views showing a process by which the barrier sheet is installed on a corner section of the building using the sheet-support system.

A process 100 of installing the moisture barrier system 10 on the building is shown in FIGS. 4 and 5. The interior wall 14 and the exterior wall 16 are first formed to sufficient heights to allow the barrier sheet 20 to be installed thereon. For example, the interior wall 14 may be higher than the external wall 16 so that the barrier sheet 20 can assume a sloped shape when installed as shown in FIG. 1. The process 100 then may begin with a step 102 of preparing the building 12 to receive the barrier sheet 20. Step 102 may include installing joint supports 50 on the building 12 at a location that coincides with an end 200 of the barrier sheet 20, as suggested at step 106, or at ends 200, 200' of neighboring barrier sheets 20, 20' as suggested at step 110. Joint supports 50 are shaped to match a fully installed barrier sheet 20 and may be formed from a rigid material to support the barrier sheet 20 in some embodiments.

The process 100 further includes a step 104 of applying sealant 52 along surface 15 of interior wall 14. During step 104, one or more beads of sealant 52 are applied along the surface 15 of interior wall where the upper attachment section 20U of the barrier sheet 20 is to be placed. The sealant 52 is also applied over a portion of the joint support(s) 50 to provide sealing between the joint support(s) 50 and the barrier sheet 20 when the barrier sheet 20 is installed. Sealant 52 may also be applied in a vertical direction along the joint support(s) 50 to seal along the entire height of the barrier sheet 20 and each joint support 50. The sealant 52 also adheres the barrier sheet 20 to the interior wall 14 and all parts of the sheet-support system 21 to which the sealant 52 is applied.

The process 100 further includes a step 106 of applying the barrier sheet 20 on the building 12. The step 106 includes deforming an upper end of the barrier sheet 20 to form the upper attachment section 20U over the sealant 52. The sealant 52 provides a seal between the upper attachment section 20U and the surface 15 of the interior wall 14. The sealant 52 also provides a seal between any interface between the joint support(s) 50 and the barrier sheet 20 where sealant 52 was applied at step 104. In the illustrative embodiment, the barrier sheet 20 terminates at a joint support 50. In other embodiments, the barrier sheet may terminate past a joint support 50 or may not terminate at all to extend all the way around the building 12. The sealant 52 retains barrier sheet 20 in a deformed position to provide upper attachment section 20U. A lower end of the barrier sheet 20 is also deformed during step 106 to provide lower attachment section 20L as shown in FIG. 4. Lower attachment section 20L is retained in a deformed position when two layers of masonry and/or mortar sandwich the lower attachment section 20L therebetween.

The process 100 further includes a step 108 of applying more sealant 52 to the end 200 of the barrier sheet 20 and a step 110 of applying a separate barrier sheet 20' to the end 200 and to the building 12 if the barrier sheet 20 does not have a length sufficient to extend all the way around the building 12. The sealant 52 is applied to an outwardly facing surface 202 of the barrier sheet 20. A corresponding end 200' of the neighboring barrier sheet 20' is then placed over the outwardly facing surface 202 and the sealant 52 to locate the sealant 52 between the ends 200, 200' of the barrier sheets 20, 20' and provide a seal therebetween. The sealant 52 also joins the ends 200, 200' of the barrier sheets 20, 20' together through adhesion at step 110. In some embodiments, the step 110 may include other means for joining such as interlocking, fastening, taping, or any other suitable joining method.

Step 110 of applying the second barrier sheet 20' to the building 12 also includes deforming the second barrier sheet 20' to form upper and lower attachment sections 20U', 20L' in the same manner discussed above in step 106. Steps 104, 106, 108 and 110 may repeat for each barrier sheet added to the building 12 along the length of a wall section 22 of the building until the entire wall section 22 includes a barrier sheet 20 along a length of the wall section 22.

The process 100 further includes a step 112 of installing a surface fixing system 54 on the upper attachment section 20U of each barrier sheet 20, 20' as shown in FIGS. 4 and 5. The surface fixing system 54 may include one or more attachment strips 70 and fasteners 72. Each attachment strip 70 is a long beam of rigid material that is placed over the upper attachment section 20U to locate the upper attachment section 20U between the surface 15 of interior wall 14 and the attachment strip 70. Fasteners 72 may then extend through the attachment strip 70 and the upper attachment section 20U and into the interior wall 14 to secure the upper attachment section 20U to the interior wall 14. Insulation 58 may be applied within cavity 19 and at least partially cover the sloped section 20S and the upper attachment section 20U of the barrier sheets 20, 20'.

Once an installer reaches a corner section 24 of the building 12 while installing the moisture barrier system 10, one or more barrier sheets 20 are then applied to a corner section 24. Process 100 include a step 114 of providing and using a corner unit 56 to shape the barrier sheet 20 to the corner section 24 as shown in FIG. 5. The corner unit 56 may be placed on the corner section 24 of the building 12 and then the barrier sheet 20 may be deformed around the corner unit 56. Sealant 52 may also be applied to surfaces of the corner unit 56 to which the barrier sheet 20 is applied to provide sealing and/or adhesion therebetween. Step 114 may include folding portions of the barrier sheet 20 to accommodate the shape of the corner that the sheet 20 is being applied on. In some embodiments, the barrier sheet 20 is rolled around a disruption, such as a corner, column, beam, window frame, etc, to provide a seamless moisture barrier over the disruption.

The process 100 may further include an additional step 116 of joining neighboring ends of two adjacently placed barrier sheets 20, 20' and applying the surface fixing system 54 after rounding a corner section 24 or a disruption as shown in FIG. 5. Step 116 may be performed in substantially the same manner described above in steps 108, 110, and 112. The surface fixing system 54 may be continuous around the entire length of the barrier sheet(s) 20, or in increments along the entire length of the barrier sheet(s) 20.

In some embodiments, the barrier sheet 20 may be cut to transition from one wall section 22 to another and form a corner section 24. The process 100 may further include a step of cutting the barrier sheet along a corner of the building 12 to provide an installed portion of the barrier sheet 20 and a remaining portion that is not installed on the building 12. The remaining portion of the barrier sheet 20 can then be shaped or cut to match an edge of the installed portion. The process may include a step of reusing the remaining portion by joining with the installed portion 20 of the barrier sheet 20 to form a corner section 24 of the moisture barrier system 10. The ends of each portion of the barrier sheet 20 may be joined to one another in substantially the same manner as described above.

In some embodiments, the moisture barrier system 10 may combine the barrier sheet 20 with other sheets to fit various disruptions along a wall section 22 and/or corner section 24. For example, the barrier sheet 20 may be applied to the building 12 on both sides of a disruption, and then a sheet may be applied over the disruption and interconnect the two barrier sheets 20 on each side of the disruption. Sealant 52, adhesives, tape, etc. may be used to join any barrier sheet 20 with another sheet and to join the sheet to the disruption to provide a seal therebetween.

Figure 6:
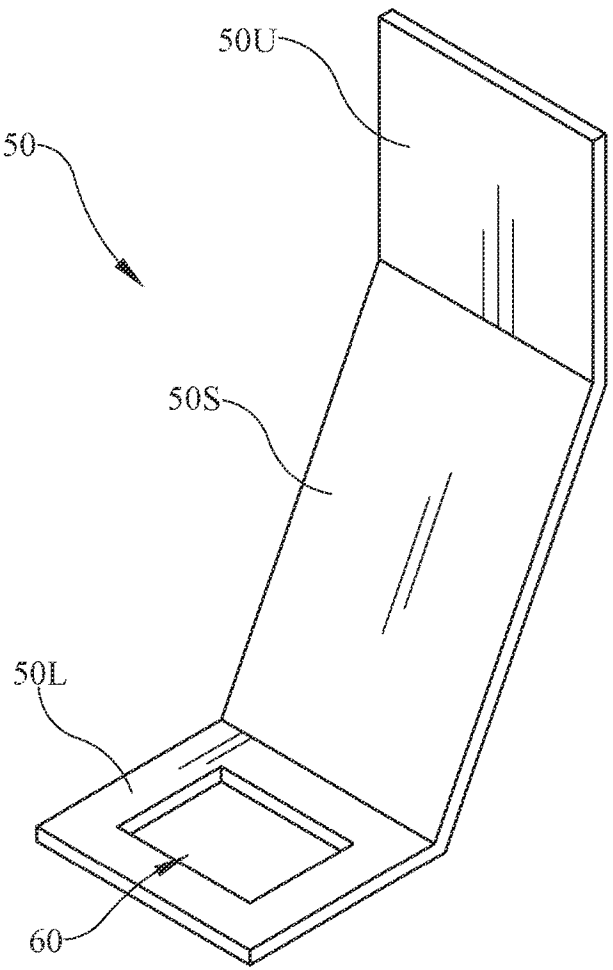
FIG. 6 is a perspective view of a joint support included in the sheet-support system which is configured to extend between the interior wall and the exterior wall along a joint section provided by two neighboring barrier sheets as shown in FIG. 4.

The joint supports 50 are shaped to support the barrier sheet(s) 20 in an installed position as shown in FIG. 1. The joint supports 50 include an upper strip 50U that is parallel with surface 15 of interior wall 14, a lower strip 50L that is parallel with surface 17 of exterior wall 16, and a sloped strip 505 that interconnects the upper strip 50U and the lower strip 50L as shown in FIG. 6. The upper strip 50U and the sloped strip 505 each have a substantially constant thickness. The lower strip 50L is formed to include an opening 60 that extends all the way through a thickness of the lower strip 50L. When the exterior wall 16 is fully formed, mortar extends through the opening 60 and surrounds the lower strip 50L to mechanically join the joint support 50 to the exterior wall 16.

Another embodiment of a joint support 250 is shown in FIG. 7. Joint support 250 is substantially similar to joint support 50 except that joint support 250 is shaped to match a differently shaped interior wall or another structure or disruption within cavity 19. Joint support 250 includes an upper strip 250U, a lower strip 250L, and a medial strip 250M interconnecting the upper strip 250U and the lower strip 250L. The upper and lower strips 250U, 250L are substantially similar to upper and lower strips 50U, 50L of joint support 50. The medial strip 250M includes a horizontal strip 250H and a sloped strip 250S. The horizontal strip 250H extends perpendicular to upper strip 250U and a general direction of travel of interior wall 14 and exterior wall 16. The sloped strip 250S extends at an angle from the horizontal strip 250H to the lower strip 250L. In one example, horizontal strip 250H is provided to extend horizontally through insulation and sloped strip 250S is provided to direct moisture toward lower strip 250L so that no portion of joint support 250 extends at an angle through the insulation. Joint supports 50, 250 may also be formed into different shapes to accommodate other structures of building 12.

The corner units 56 are shaped to support the barrier sheet(s) 20 in the installed position on a corner 24 shown in FIG. 1. Each corner unit 56 includes an upper strip 56U, a lower strip 56L, and a sloped strip 56S as shown in FIG. 8. The upper strip 56U is parallel with surface 15 of interior wall 14 and extends around corner 24 to interface with two walls of the interior wall 14 of building 12. The lower strip 56L is parallel with surface 17 of exterior wall 16 and extends around corner 24 to interface with two walls of the exterior wall 16 of building 12. The sloped strip 56S interconnects the upper strip 56U and the lower strip 56L and extends downwardly at an angle through cavity 19. The sloped strip 56S also extends around corner 24 along two walls of building 12. Upper strip 56U and sloped strip 56S each have portions that join together at a point 57 which coincides with corner 24.

Figure 9:
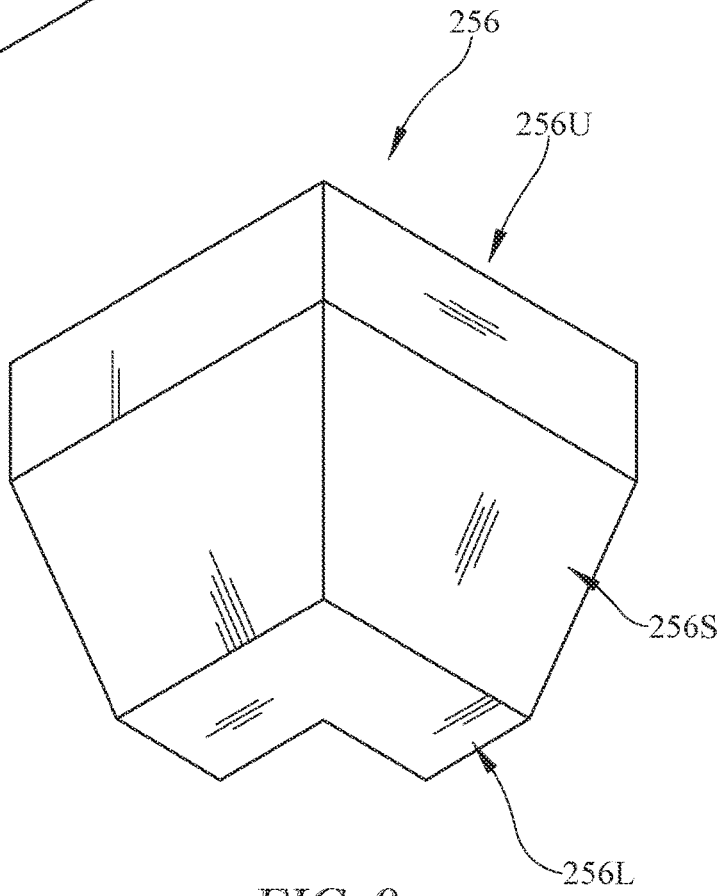
FIG. 9 is a perspective view of an internal corner support included in the sheet-support system which is configured to extend between the interior wall and the exterior wall along an internal corner section of the building to support the barrier sheet in an internal corner formation along the external corner section of the building.

Corner units may be shaped to extend around external corners, as shown in FIG. 8, or internal corners as shown in FIG. 9. External corners have a point which faces away from interior wall 14 of building 12. Internal corners have a point which faces toward interior wall 14 of building 12. Corner unit 56 is shaped to extend around an exterior corner. An example of a corner unit 256 which is shaped to extend around an interior corner is shown in FIG. 9. Corner unit 256 also includes an upper strip 256U, a lower strip 256L, and a sloped strip 256S similar to corner unit 56. Corner strips 56, 256 may take other shapes to accommodate other structures of building 12 or differently shaped corners such as a rounded corner, for example.

Another embodiment of a corner unit 356 is shown in FIG. 10. Corner unit 350 is substantially similar to corner unit 50 except that corner unit 350 is shaped to match a differently shaped interior wall or another structure or disruption within cavity 19. Corner unit 350 includes an upper strip 350U, a lower strip 350L, and a medial strip 350M interconnecting the upper strip 350U and the lower strip 350L. The upper and lower strips 350U, 350L are substantially similar to upper and lower strips 56U, 56L of corner unit 56. The medial strip 350M includes a horizontal strip 350H and a sloped strip 350S. The horizontal strip 350H extends perpendicular to upper strip 350U and a general direction of travel of interior wall 14 and exterior wall 16. The sloped strip 350S extends at an angle from the horizontal strip 350H to the lower strip 350L. In one example, horizontal strip 350H is provided to extend horizontally through insulation and sloped strip 350S is provided to direct moisture toward lower strip 350L so that no portion of corner unit 350 extends at an angle through the insulation. Corner units 56, 356 may also be formed into different shapes to accommodate other structures of building 12.

An example of a corner unit 456 which is shaped to extend around an interior corner is shown in FIG. 11. Corner unit 456 also includes an upper strip 456U, a lower strip 456L, and a medial strip 456M similar to corner unit 356. Corner strips 356, 436 may take other shapes to accommodate other structures of building 12 or differently shaped corners such as a rounded corner, for example.

In some embodiments, external masonry walls of modern buildings are generally cavity walls; that is, they are formed by an inner leaf and an outer leaf of masonry, often tied together, but separated by an air gap or cavity. The cavity minimizes moisture transmitting from the outer leaf to the inner leaf. It can also provide a ventilation space, allowing moisture within the wall construction to vent to the outside, and can provide a space for the installation of cavity wall insulation.

In some embodiments, cavity trays may block moisture that is travelling downwards from being carried to the inner leaf, whereas damp-proof courses may be used to minimize rising damp. A cavity tray may be thought of as a damp-proof course that crosses the cavity of a cavity wall in order to block dampness from permeating the internal skin of a wall.

In some embodiments, cavity trays can be formed using a pliable material such as lead, but may be pre-formed either on-site or off-site (for example from plastics materials), with a wide range of shapes allowing for different cavity widths, corners, stop ends, steps, lintel shapes, arch shapes and sometimes incorporating external flashing. A consideration when installing moisture barriers is the fire risk that may be posed by their introduction.

In some embodiments, the polymer layer 26 may be referred to as a matrix material, and the matrix material may comprise one or more of: silicones, polyurethane, epoxy, phenolics, polyester, vinyl ester. The matrix material may comprise a thermoset or thermoplastic material. In some embodiments the matrix material comprises a silicone. In some embodiments the matrix material consists of a silicone.

In some embodiments, the damp proof course of the present disclosure may be formed as a cavity tray. The present disclosure also provides a cavity tray comprising a damp-proof course as described herein. The present disclosure may provide a cavity wall having a damp-proof course as described herein, or a cavity tray as described herein.

In some embodiments, aspects and embodiments of the present disclosure may provide a cavity tray with one or more of the following features: water and damp resistant, flexible, easy to install, high puncture resistance, reinforced product, and available in rolls or discreet pieces.

In some embodiments, damp proof courses or DPCs may be inserted into the wall structure to stop the movement of moisture from rising up the wall or moving from one part of the structure to another (often seen 150 mm above external ground level). When used in wider widths, the DPC is draped across the cavity stepping up a minimum of 150 mm from the outer to the inner leaf over a lintel. The DPC may include a cavity tray. The cavity tray may have a wider width of DPC; 450 mm and above, for example. Any rainwater seeping through the outer leaf of the wall and trickling down the cavity face of the outer leaf is collected by the cavity tray and diverted toward weepholes in the outer leaf.

When used above a window or doorway it may be referred to as a discontinuous cavity tray extending at least to the ends of the lintel. Rainwater is blocked from running off the ends of the tray by creating stop ends with the DPC material itself by turning it up the full height of the outer leaf perpend (vertical joint in the masonry) or using preformed stop ends units. The DPC and/or cavity tray continually bridges the cavity e.g. fire stops or brickwork support angles. The tray is continuous and runs right the way around the building. When it reaches corners preformed corner units may be used which match the profile of the cavity tray and structures of the building. The cavity tray profiles are built into the inner leaf. If the inner leaf is a structural framing system, the cavity tray would be surface fixed to the inner leaf. The cavity tray may be partially embedded into the inner leaf.

In some embodiments, a system includes the DPC, the preformed cavity tray(s), mastic sealant, joint support(s), and fixing strip(s). The DPC may be rolled due to its flexibility and may include one of the following, non-limiting heights: 450 mm, 500 mm, 600 mm, 700 mm, 800 mm & 900 mm.

In some embodiments, the mastic sealant 52 may be contained within a cartridge. An overlap of at adjoining ends of neighboring damp-proof courses may be provided and sealant may be placed therebetween. In one example, at least 900 mm of overlap is provided. Sealant is placed between the two courses at the overlap in such embodiments. The mastic sealant may be stored and transported in standard 380 ml cartridges and applied using a skeleton gun.

In some embodiments, the cavity tray corners are formed to match a contour of the building. In this way, each cavity tray corner may include a series of steps or slopped surfaces along its height. The cavity tray corners may be formed from a metal such as stainless steel or another suitable material.

In some embodiments, the joint supports are arrange to lie beneath overlapping ends of DPC and/or beneath ends of DPC and a cavity tray. Each joint support may include a metal material such as stainless steel or another suitable material. A lower flange of the joint supports may be formed to include an aperture. Masonry material used to join external wall building materials (i.e. bricks) can flow through the aperture to bind the joint supports to the building. Each joint support can be shaped to match surfaces or structures of the building.

In some embodiments, the fixing strip(s) are an elongated strip that extends along an upper end of the DPC. Each fixing strip(s) is formed to include apertures that receive fasteners to secure the DPC and the joint support to the inner leaf. The fixing strip(s) may be made from a metal material such as stainless steel or any other suitable material.

Non Combustibility Tests:

Embodiments may be designed to achieve an A1 or A2 non-combustibility classification accordingly to BS EN13501-1 (Fire Test to Building Material). There are multiple tests to measure combustibility properties of a product, which are described in the table of FIG. 3. Some embodiments of the present disclosure meet A2, s1 (smoke propagation), and d0 (flaming droplets and particles) requirements according to BS EN13501-1 at the time of filing this application.

Test 1: EN ISO 1716:2018 Bomb Calorimetry Test

Sample is fully combusted in a sealed container and internal energy change is measured. This is a test for all the components in the product. The fiber used for some embodiments, which may be the significant component in the construction, passed A1 classification.

Test 2: BS EN 13823:2010 Single Burning Item

Product constructed in situ and allowed to burn for a defined duration. Gas burner at 30 kW directly on the sample for 21 minutes. Combustion gases are collected to determine smoke growth rate and total smoke production for a 10 minute duration. To pass A2 requirements, the smoke growth rate should be less than 30 m2/s2 and total smoke production should be less than 50 m2.

The following numbered clauses include embodiments that are contemplated and non-limiting:

Clause 1. A method of installing a moisture barrier on a building having an interior wall and an exterior wall spaced apart from the interior wall to define a cavity therebetween.

Clause 2. The method of clause 1, any other suitable clause, or any suitable combination of clauses, including applying sealant to an exterior-facing surface of the interior wall in a line extending horizontally at least partially around the interior wall of the building.

Clause 3. The method of clause 2, any other suitable clause, or any suitable combination of clauses, including providing a barrier sheet.

Clause 4. The method of clause 3, any other suitable clause, or any suitable combination of clauses, including applying an upper section of the barrier sheet to the exterior-facing surface of the interior wall over the sealant.

Clause 5. The method of clause 4, any other suitable clause, or any suitable combination of clauses, including applying a lower section of the barrier sheet to the exterior wall.

Clause 6. The method of clause 5, any other suitable clause, or any suitable combination of clauses, including deforming the upper section of the barrier sheet to be parallel with the exterior-facing surface of the interior wall.

Clause 7. The method of clause 6, any other suitable clause, or any suitable combination of clauses, including deforming the lower section of the barrier sheet to be parallel with an upper surface of the exterior wall.

Clause 8. The method of clause 7, any other suitable clause, or any suitable combination of clauses, wherein a medial section of the barrier sheet extends at a downwardly sloped angle from the upper section to the lower section.

Clause 9. The method of clause 8, any other suitable clause, or any suitable combination of clauses, including retaining the upper section of the barrier sheet to the interior wall with the sealant.

Clause 10. The method of clause 9, any other suitable clause, or any suitable combination of clauses, including retaining the lower section of the barrier sheet to the exterior wall between two layers of masonry included in the exterior wall of the building.

Clause 11. The method of clause 10, any other suitable clause, or any suitable combination of clauses, including adhering a plurality of barrier sheets to one another by adhering opposing ends of each barrier sheet together to provide a continuous seal dividing upper and lower cavity subsections around a perimeter of the building.

Clause 12. The method of clause 11, any other suitable clause, or any suitable combination of clauses, wherein the opposing ends of each barrier sheet are adhered together by sealant.

Clause 13. The method of clause 11, any other suitable clause, or any suitable combination of clauses, including supporting the opposing ends of each barrier sheet with a joint support that is arranged to lie on an underside of the barrier sheets.

Clause 14. The method of clause 13, any other suitable clause, or any suitable combination of clauses, wherein each joint support includes an upper strip corresponding to the upper section of the barrier sheets, a lower strip corresponding to the lower section of the barrier sheets, and a sloped strip corresponding with the medial section of the barrier sheets.

Clause 15. The method of clause 14, any other suitable clause, or any suitable combination of clauses, wherein the lower strip is formed to include an opening and mortar extends through the opening to mechanically join the joint support to the exterior wall of the building.

Clause 16. The method of clause 10, any other suitable clause, or any suitable combination of clauses, wherein retaining the upper section to the interior wall includes attaching a surface fixing system to the upper end, the surface fixing system including an attachment strip that extends longitudinally along the upper section and a plurality of fasteners that each extend through a corresponding opening formed in the attachment strip, through the upper section and into the interior wall.

Clause 17. The method of clause 10, any other suitable clause, or any suitable combination of clauses, including placing a corner unit at each corner of the building, each corner unit including an upper strip corresponding to the upper section of the barrier sheets, a lower strip corresponding to the lower section of the barrier sheets, and a sloped strip corresponding with the medial section of the barrier sheets.

Clause 18. The method of clause 10, any other suitable clause, or any suitable combination of clauses, wherein the barrier sheet includes an interior reinforcement mesh and a polymer encapsulating the interior reinforcement mesh.

Clause 19. The method of clause 18, any other suitable clause, or any suitable combination of clauses, wherein the interior reinforcement mesh comprises at least one of glass fiber, aramids, carbon fiber, graphite fiber, ultra-high-molecular-weight polyethylene (UHMWPE), PEEK (polyetheretherketone), and mineral wool.

Clause 20. The method of clause 19, any other suitable clause, or any suitable combination of clauses, wherein the polymer consists of silicone.

Clause 21. The method of clause 18, any other suitable clause, or any suitable combination of clauses, wherein the interior reinforcement mesh is woven and defines a plurality of voids and the polymer extends through the plurality of voids to locate the polymer on both sides of the reinforcement mesh.

Clause 22. The method of clause 18, any other suitable clause, or any suitable combination of clauses, wherein the polymer includes silicone.

Clause 23. The method of clause 18, any other suitable clause, or any suitable combination of clauses, wherein the polymer includes polyurethane.

Clause 24. The method of clause 18, any other suitable clause, or any suitable combination of clauses, wherein the polymer includes a thermoplastic.

Clause 25. The method of clause 18, any other suitable clause, or any suitable combination of clauses, wherein the polymer includes rubber.

Clause 26. The method of clause 10, any other suitable clause, or any suitable combination of clauses, wherein applying the upper section of the barrier sheet and applying the lower section of the barrier sheet is performed on a wall section of the building and the method further comprises applying the upper section and lower section of the barrier sheet to a disruption of the building by deforming at least one of the upper section and the lower section to form a deformed position around the disruption.

Clause 27. A moisture barrier system adapted to be installed on a building having an interior wall and an exterior wall spaced apart from the interior wall to define a cavity there between.

Clause 28. The moisture barrier system of clause 27, any other suitable clause, or any suitable combination of clauses, including a barrier sheet.

Clause 29. The moisture barrier system of clause 28, any other suitable clause, or any suitable combination of clauses, wherein the barrier sheet includes an interior reinforcement mesh and an outer polymeric layer encapsulating the interior reinforcement mesh.

Clause 30. The moisture barrier system of clause 29, any other suitable clause, or any suitable combination of clauses, including a sheet support system configured to support and join the barrier sheet to the interior wall and the exterior wall.

Clause 31. The moisture barrier system of clause 30, any other suitable clause, or any suitable combination of clauses, the sheet support system including sealant coupled to an exterior-facing surface of the interior wall to lie between the exterior-facing surface and an upper section of the barrier sheet.

Clause 32. The moisture barrier system of clause 30, any other suitable clause, or any suitable combination of clauses, including a corner unit arranged to extend around a corner of the building and to lie beneath the barrier sheet at the corner.

Clause 33. The moisture barrier system of clause 30, any other suitable clause, or any suitable combination of clauses, including a surface fixing system configured to mount the upper section of the barrier sheet to the interior wall.

Clause 34. The moisture barrier system of clause 33, any other suitable clause, or any suitable combination of clauses, the surface fixing system including an attachment strip and a plurality of fasteners that each extend through a corresponding opening formed in the attachment strip, through the upper section of the barrier sheet, and into the interior wall.

Clause 35. The moisture barrier system of clause 29, any other suitable clause, or any suitable combination of clauses, including a second barrier sheet, wherein neighboring ends of the barrier sheet and the second barrier sheet overlap and sealant is arranged to lie between the neighboring ends.

Clause 36. The moisture barrier system of clause 35, any other suitable clause, or any suitable combination of clauses, including a joint support extending between and interconnecting the interior wall and the exterior wall and arranged to lie beneath the neighboring ends of the barrier sheet and the second barrier sheet.

Clause 37. A method of installing a moisture barrier on a building having an interior wall and an exterior wall spaced apart from the interior wall to define a cavity there between, the method including: providing a barrier sheet.

Clause 38. The method of clause 37, any other suitable clause, or any suitable combination of clauses, including applying an upper section of the barrier sheet to the exterior-facing surface of the interior wall.

Clause 39. The method of clause 38, any other suitable clause, or any suitable combination of clauses, including applying a lower section of the barrier sheet to the exterior wall.

Clause 40. The method of clause 39, any other suitable clause, or any suitable combination of clauses, including deforming the upper section of the barrier sheet to be parallel with the exterior-facing surface of the interior wall.

Clause 41. The method of clause 40, any other suitable clause, or any suitable combination of clauses, including deforming the lower section of the barrier sheet to be parallel with an upper surface of the exterior wall, wherein a medial section of the barrier sheet extends at a downwardly sloped angle from the upper section to the lower section.

Clause 42. The method of clause 41, any other suitable clause, or any suitable combination of clauses, including retaining the lower section of the barrier sheet to the exterior wall between two layers of masonry included in the exterior wall of the building.

Clause 43. A barrier sheet configured to be installed within a cavity of a building having an interior wall and an exterior wall spaced apart from the interior wall to define the cavity there between.

Clause 44. The barrier sheet of clause 43, any other suitable clause, or any suitable combination of clauses, including an interior reinforcement mesh.

Clause 45. The barrier sheet of clause 44, any other suitable clause, or any suitable combination of clauses, including a polymer encapsulating the interior reinforcement mesh.

Clause 46. The barrier sheet of clause 45, any other suitable clause, or any suitable combination of clauses, wherein the interior reinforcement mesh comprises at least one of glass fiber, aramids, carbon fiber, graphite fiber, ultra-high-molecular-weight polyethylene (UHMWPE), PEEK (polyetheretherketone), and mineral wool.

Clause 47. The barrier sheet of clause 46, any other suitable clause, or any suitable combination of clauses, wherein the polymer consists of silicone.

Clause 48. The barrier sheet of clause 46, any other suitable clause, or any suitable combination of clauses, wherein interior reinforcement mesh is woven and defines a plurality of voids and the polymer extends through the plurality of voids to locate the polymer on both sides of the reinforcement mesh.

Clause 49. The barrier sheet of clause 46, any other suitable clause, or any suitable combination of clauses, wherein the polymer includes silicone.

Clause 50. The barrier sheet of clause 46, any other suitable clause, or any suitable combination of clauses, wherein the polymer includes polyurethane.

Clause 51. The barrier sheet of clause 46, any other suitable clause, or any suitable combination of clauses, wherein the polymer includes a thermoplastic.

Clause 52. The barrier sheet of clause 46, any other suitable clause, or any suitable combination of clauses, wherein the polymer includes rubber.

The invention claimed is:

1. A method of installing a moisture barrier on a building having an interior wall and an exterior wall spaced apart from the interior wall to define a cavity therebetween, the method comprising applying a sealant to an exterior-facing surface of the interior wall in a line extending horizontally at least partially around the interior wall of the building, providing a plurality of barrier sheets, applying an upper section of the plurality of barrier sheets to the exterior-facing surface of the interior wall over the sealant, applying a lower section of the plurality of barrier sheets to the exterior wall, deforming the upper section of the plurality of barrier sheets to be parallel with the exterior-facing surface of the interior wall, deforming the lower section of the plurality of barrier sheets to be parallel with an upper surface of the exterior wall, wherein a medial section of the plurality of barrier sheets extend at a downwardly sloped angle from the upper section to the lower section, retaining the upper section of the plurality of barrier sheets to the interior wall with the sealant, retaining the lower section of the plurality of barrier sheets to the exterior wall between two layers of masonry included in the exterior wall of the building, adhering the plurality of barrier sheets to one another by adhering opposing ends of each of the plurality of barrier sheets together to provide a continuous seal dividing upper and lower cavity subsections around a perimeter of the building, and supporting the opposing ends of each of the plurality of barrier sheets with a joint support that is arranged to lie on an underside of the barrier sheets, wherein the joint support includes an upper strip corresponding to the upper section of the barrier sheets, a lower strip corresponding to the lower section of the barrier sheets, and a sloped strip corresponding with the medial section of the barrier sheets, and wherein the lower strip is formed to include an opening and mortar extends through the opening to mechanically join the joint support to the exterior wall of the building.

2. The method of claim 1, wherein the opposing ends of each of the plurality of barrier sheets are adhered together by a second sealant.

3. The method of claim 1, wherein retaining the upper section to the interior wall includes attaching a surface fixing system to the upper section of the plurality of barrier sheets, the surface fixing system including an attachment strip that extends longitudinally along the upper section and a plurality of fasteners that each extend through a corresponding opening formed in the attachment strip, through the upper section and into the interior wall.

4. The method of claim 1, further comprising placing a corner unit at a corner of the building, the corner unit including an upper strip corresponding to the upper section of at least one barrier sheet included in the plurality of barrier sheets, a lower strip corresponding to the lower section of the at least one barrier sheet included in the plurality of barrier sheets, and a sloped strip corresponding with the medial section of the at least one barrier sheet included in the plurality of barrier sheets.

5. The method of claim 1, wherein at least one barrier sheet included in the plurality of barrier sheets includes an interior reinforcement mesh and a polymer encapsulating the interior reinforcement mesh.

6. The method of claim 5, wherein the interior reinforcement mesh comprises at least one of glass fiber, aramids, carbon fiber, graphite fiber, ultra-high-molecular-weight polyethylene (UHMWPE), PEEK (polyetheretherketone), and mineral wool.

7. The method of claim 6, wherein the polymer consists of silicone.

8. The method of claim 5, wherein the interior reinforcement mesh is woven and defines a plurality of voids and the polymer extends through the plurality of voids to locate the polymer on both sides of the reinforcement mesh.

9. The method of claim 5, wherein the polymer includes silicone.

10. The method of claim 5, wherein the polymer includes polyurethane.

11. The method of claim 5, wherein the polymer includes a thermoplastic.

12. The method of claim 5, wherein the polymer includes rubber.

13. The method of claim 1, wherein applying the upper section and applying the lower section of at least one barrier sheet included in the plurality of barrier sheets is performed on a wall section of the building and the method further comprises applying the upper section and the lower section of the at least one barrier sheet included in the plurality of barrier sheets to a disruption of the building by deforming at least one of the upper section and the lower section to form a deformed position around the disruption.

14. A moisture barrier system adapted to be installed on a building having an interior wall and an exterior wall spaced apart from the interior wall to define a cavity there between, the moisture barrier system comprising:

a first barrier sheet including an interior reinforcement mesh and an outer polymeric layer encapsulating the interior reinforcement mesh, a second barrier sheet, wherein neighboring ends of the first barrier sheet and the second barrier sheet overlap, and a sheet support system configured to support and join the first barrier sheet and the second barrier sheet to the interior wall and the exterior wall, the sheet support system including a sealant coupled to an exterior-facing surface of the interior wall to lie between the exterior-facing surface and an upper section of the first barrier sheet and the second barrier sheet, a corner unit arranged to extend around a corner of the building and to lie beneath at least one of the first barrier sheet and the second barrier sheet at the corner, a surface fixing system configured to mount the upper section of the first barrier sheet and the second barrier sheet to the interior wall, the surface fixing system including an attachment strip and a plurality of fasteners that each extend through a corresponding opening formed in the attachment strip, through the upper section of the first barrier sheet and the second barrier sheet, and into the interior wall, and a joint support extending between and interconnecting the interior wall and the exterior wall and arranged to lie beneath the neighboring ends of the first barrier sheet and the second barrier sheet, wherein the joint support includes an upper strip corresponding to the upper section of the first and second barrier sheets, a lower strip corresponding to a lower section of the first and second barrier sheets, and a sloped strip corresponding with a medial section of the first and second barrier sheets, and wherein the lower strip of the joint support is formed to include an opening so that mortar extends through the opening to mechanically join the joint support to the exterior wall of the building.

15. The moisture barrier system of claim 14, wherein the interior reinforcement mesh comprises at least one of glass fiber, aramids, carbon fiber, graphite fiber, ultra-high-molecular-weight polyethylene (UHMWPE), PEEK (polyetheretherketone), and mineral wool.

16. The moisture barrier system of claim 14, wherein the interior reinforcement mesh is woven and defines a plurality of voids and the outer polymeric layer extends through the plurality of voids to locate the outer polymeric layer on both sides of the reinforcement mesh.

17. The moisture barrier system of claim 14, wherein the outer polymeric layer includes silicone.

18. The moisture barrier system of claim 14, wherein the outer polymeric layer includes polyurethane.

19. The moisture barrier system of claim 14, wherein the outer polymeric layer includes a thermoplastic.

20. The moisture barrier system of claim 14, wherein the outer polymeric layer includes rubber.

* * * * *